United States Patent [19]

Sherwin et al.

[11] Patent Number: 4,930,145

[45] Date of Patent: May 29, 1990

[54] X-RAY EXPOSURE REGULATOR

[75] Inventors: Karl F. Sherwin; Manfred D. Boehm, both of Waukesha, Wis.

[73] Assignee: General Electric Company, Milwaukee, Wis.

[21] Appl. No.: 232,498

[22] Filed: Aug. 15, 1988

[51] Int. Cl.[5] ..... H05G 1/32

[52] U.S. Cl. ..... 378/109; 378/110; 378/111; 378/112

[58] Field of Search ..... 378/101, 109–112

[56] References Cited

U.S. PATENT DOCUMENTS

| | | | |
|---|---|---|---|
| 3,521,067 | 7/1970 | Splain | 378/110 |
| 3,974,387 | 8/1976 | Bronner et al. | 250/409 |
| 4,177,406 | 12/1979 | Hermeyer et al. | 378/110 |
| 4,322,797 | 3/1982 | Lickel et al. | 378/110 |
| 4,366,575 | 12/1982 | Bax | 378/112 |
| 4,797,908 | 1/1989 | Tanaka et al. | 378/112 |

FOREIGN PATENT DOCUMENTS

| | | | |
|---|---|---|---|
| 0061599 | 4/1983 | Japan | 378/110 |

*Primary Examiner*—Carolyn E. Fields
*Assistant Examiner*—David P. Porta
*Attorney, Agent, or Firm*—Quarles & Brady

[57] ABSTRACT

A filament current regulator for an X-ray generator includes a circuit which compares the actual X-ray tube filament current to a predefined filament current reference value. Another circuit is included which compares the actual X-ray tube excitation voltage, applied across the anode and to cathode of the tube, to a predefined reference voltage value. The regulator adjusts the filament current during a first time interval of an exposure based on only the filament current comparison, and during the remainder of the exposure based substantially on the excitation voltage comparison. The regulator apparatus also integrates the difference between the actual filament current and the reference current value over a given interval during the exposure. The integrated result is employed by the regulator to redefine the filament current reference value.

13 Claims, 2 Drawing Sheets

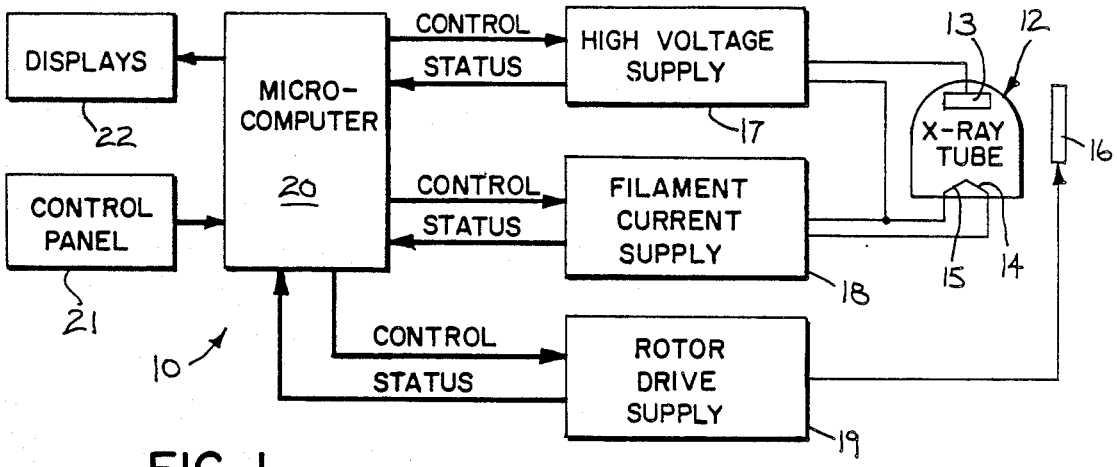
FIG. 1
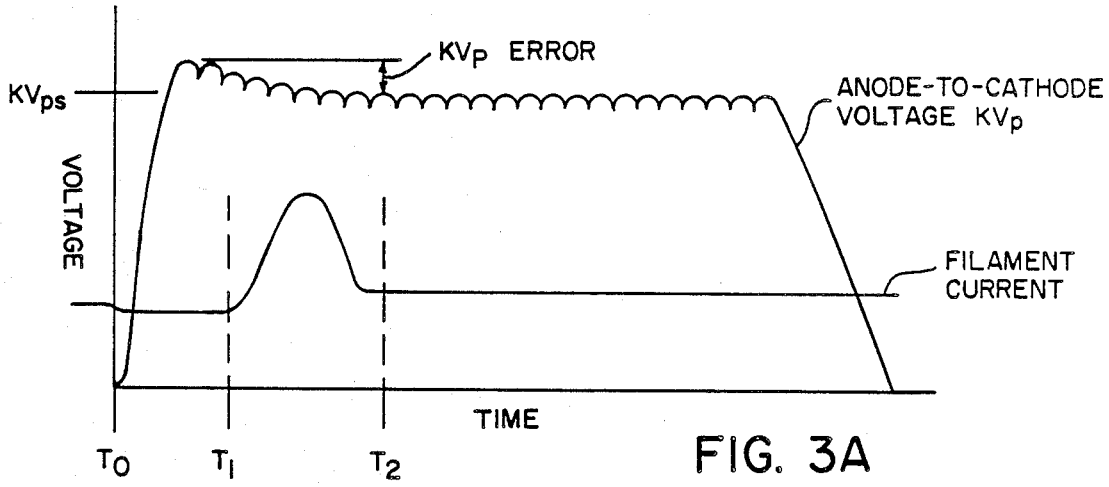
FIG. 3A
FIG. 3B
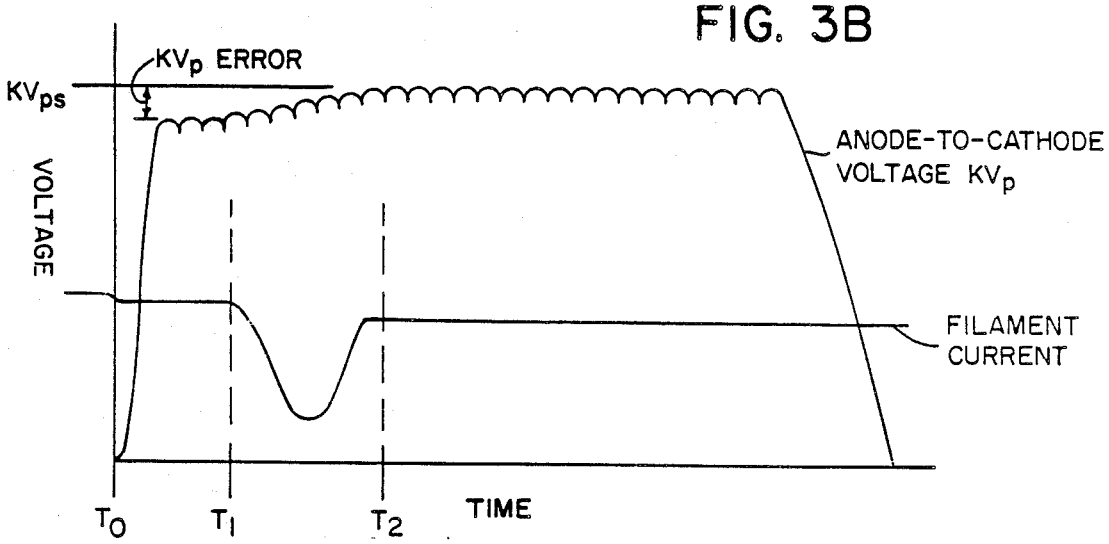

X-RAY EXPOSURE REGULATOR

BACKGROUND OF THE INVENTION

The present invention relates to X-ray diagnostic imaging systems and more particularly to the systems' regulation of the X-ray exposure.

Conventional X-ray imaging equipment has a vacuum tube which when electrically excited emits X-rays. This tube includes a filament to heat the cathode of the tube to an operating temperature. Once at this temperature, a high d.c. voltage is applied across an anode and a cathode resulting in an electron beam bombarding the anode to produce X-ray emission. The X-ray tube can be electrically modeled as a variable resistor, the resistance of which being a function of the temperature of the tube's filament, and therefore the filament current. Within the filament's operating temperature range, the emission current flowing between the anode and the cathode, and hence the X-ray emission, is proportional to the filament current.

Because of the hazards associated with overexposure to X-rays, as well as the need to control the exposure for accurate imaging purposes, it is necessary to closely regulate the X-ray emission. One previous method of accomplishing this regulation involved continuously comparing the actual anode-to-cathode voltage to a reference level and varying the filament current, based on the result of the comparison, until the desired voltage was achieved. The feedback loop contained an amplifier, in the filament current supply, having its gain controlled by the voltage comparison. In an improved version of this method, the filament current also was sensed continuously to produce a feedback signal which controlled the amount of current applied to the filament.

This type of exposure regulation suffers from the relatively long thermal time constant of the filament which prevents rapid control of the high voltage across the anode and cathode of the tube. Furthermore, as each X-ray tube has slightly different characteristics, one cannot accurately provide a fixed compensation for variation of the anode-to-cathode excitation voltage. In addition, some X-ray exposures may be so short in duration that the exposure does not last beyond the initial period when conventional regulation is inaccurate.

SUMMARY OF THE INVENTION

An X-ray diagnostic imaging apparatus includes a vacuum tube which is capable of emitting X-rays upon excitation, a source of a high excitation voltage potential, and a source of filament current for the tube. The present invention involves a novel apparatus and method for regulating the filament current applied to the tube and as a result for controlling the emission of X-rays from the tube.

The regulator for accomplishing this result has a first mechanism for comparing the actual filament current to a predefined reference current value. A second mechanism compares the actual excitation voltage applied to the tube to a predefined reference voltage value. In the typical imaging apparatus in which this regulator can be used, the X-ray technician selects the tube excitation voltage for the exposure which thereby defines corresponding filament current and excitation voltage reference values to be employed. The regulator controls the filament current during an initial period of the exposure in response to only the first mechanism for comparing.

Thereafter, for the remainder of the exposure, the regulation of the filament current is substantially in response to the second mechanism for comparing.

The general object of the present invention is to provide a means for controlling an X-ray exposure by regulating the filament current applied to the X-ray generating tube.

A more specific object is to accomplish the regulation during an initial period of the exposure by comparing the actual filament current to a known reference level and during a second period of the exposure by comparing the actual anode-to-cathode voltage to another reference level. Both reference levels are determined by the selected excitation voltage for the exposure.

Another object of the instant invention is to employ substantially only the comparison of the anode-to-cathode excitation voltage in regulating the exposure during the second period.

Yet another object is to sample the actual filament current during a given interval and employ the results of the sampling in defining the reference filament current levels for a subsequent exposure.

BRIEF DESCRIPTION OF THE DRAWINGS

FIG. 1 is a block diagram of an X-ray imaging system into which the present invention is incorporated;

FIGS. 3A and 3B are a graphs of the anode-to-cathode voltage and the filament current during two X-ray exposures.

DESCRIPTION OF THE PRESENT INVENTION

Figure 2:
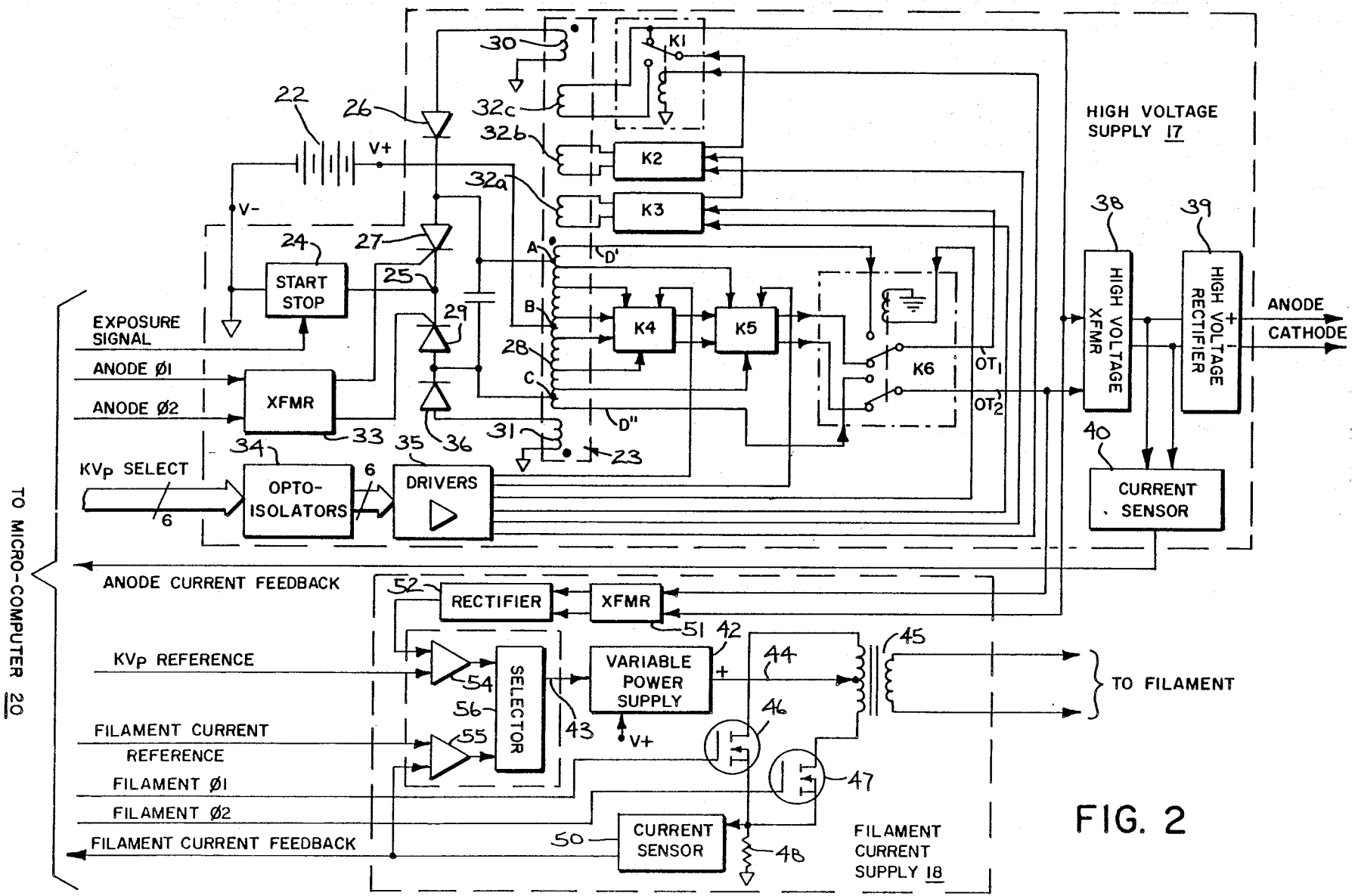
FIG. 2 is a detailed schematic diagram of the anode and filament supplies which incorporate components of the present invention.

FIG. 1 shows the control circuitry for a typical X-ray generator 10 which produces an X-ray beam for diagnostic imaging purposes. The generator includes a conventional X-ray vacuum tube 12 having a rotating anode 13. Associated with the tube is a stator coil 16 which produces an electromagnetic field within the tube 12 causing the anode 13 to rotate. The X-ray tube 12 also includes a cathode 14 electrically coupled to a filament 15.

The X-ray generator 10 has a high voltage supply 17 which produces a d.c. excitation voltage that is applied between the cathode 14 and the anode 13. A filament current supply 18 produces a current which heats the filament 15 to an operating temperature. A rotor drive supply 19 produces an electrical current for the stator 16 which generates the electromagnetic field to rotate the tube anode 13. In addition to being coupled to a source of electricity (not shown), each of the electrical supplies 17, 18, and 19 is connected to a microcomputer 20. The supplies 17–18 receive control signals from the microcomputer which govern their operation, and feedback signals indicating their status to the microcomputer 20.

The generator 10 also includes a control panel 21 at which the X-ray technician enters information regarding the operation of the generator and the parameters for an X-ray exposure. For example, the technician defines an exposure by selecting one of several predefined anode-to-cathode voltage potentials at which to excite the X-ray tube, and the emission current-time product of the exposure. Based on this selection, other parameters of the exposure, such as the emission current and filament current, are automatically set by the microcomputer. A display panel 22 is coupled to the microcomputer 20 to provide a visual indication of the generator's status to the technician.

The block diagram illustrated in FIG. 1 represents a generic X-ray generator 10. The present invention will be described with respect to a portable battery-powered X-ray generator, although the concepts of the invention have application to many types of X-ray generators.

FIG. 2 illustrates the details of the high voltage supply 17, which receives its power from a bank of batteries 22. The negative terminal of the battery bank 22 is coupled to a start/stop control circuit 24 which selectively couples the negative battery terminal to a node 25 in response to an exposure signal from the microcomputer 20. A first SCR 27 connects one end tap A of the main winding 28 of an auto-transformer 23 to node 25. A second SCR 29 couples a tap C at the other end of the auto-transformer winding 28 to node 25. The gates of each of the SCR's 27 and 29 receive separate 1 KHz pulsed signals, designated anode $\phi 1$ and anode $\phi 2$, from the microcomputer 20 via an isolation transformer 33. A central tap B of the main auto-transformer winding 28 is coupled to the positive terminal of battery bank 22.

The main winding 28 of the auto-transformer 23 has a plurality of other taps coupled to three relays K4, K5 and K6. These relays are identical and the details of relay K6 are illustrated in FIG. 2. The three relays are connected in a cascade. One of these relays is energized for a given exposure to select a pair of symmetrically located taps on the main winding 28. Relay K6 is the final one in the cascade and has one output line coupled to relay K3. Depending upon whether the coil of relay K6 is energized, the relay will connect either taps D' and D" or the output terminals of relay K5 to its output terminals OT1 and OT2. The other two relays K4 and K5 can be energized to select other taps on the main winding 28.

Another set of three relays K1, K2 and K3 can be separately energized to couple one or more auto-transformer coils 32*a*, 32*b*, and 32*c* in series with the first output terminal OT1 of relay K6. Relays K1–K3 are identical and the details of relay K1 are illustrated. The output of relay K1 and the other output line of relay K6 are coupled across the primary winding of a high voltage transformer 38 which has a fixed turns ratio.

The auto-transformer 23 also includes windings 30 and 31. The first of these, winding 30, is coupled by diode 26 to tap A of the main winding 28. Similarly, winding 31 is coupled by another diode 36 to tap C of the main auto-transformer winding 28. The connection of windings 30 and 31 serves to reduce the circulating current in the auto-transformer 23.

The technician configures the system for an exposure by chosing the X-ray tube excitation voltage KVps on the control panel 21. In response to the technician's input, the microcomputer 20 generates a six bit auto-transformer control signal designated "KVp select", which is coupled by a set of opto-isolators 34 and a set of drivers 35 to the coils of the auto-transformer relays K1–K6. Each relay is energized by a different bit of the KVp select signal. By selectively energizing various combinations of the auto-transformer relays K1–K6, the effective turns ratio of the auto-transformer 23 can be varied; thereby altering the voltage produced across the primary winding of the high voltage transformer 38. This configures the power supply 17 to produce the selected excitation voltage.

To commence an X-ray exposure, the microcomputer generates an exposure signal and a safety stop signal respectively rendering the start/stop control circuit 24 conductive. This applies the potential from the battery bank 22 across node 25 and the center auto-transformer tap A. At this time, the microcomputer 20 is also generating the anode $\phi 1$ and anode $\phi 2$ SCR switching signals, which are 180 degrees out of phase with respect to each other to alternately switch SCR's 27 and 29. The switching of the two SCR's sends a series of d.c. current pulses through the different halves of the auto-transformer, thereby producing an alternating intermediate voltage across the primary winding of the high voltage transformer 38.

The fixed ratio high voltage transformer 38 steps up the intermediate voltage to the selected excitation voltage, KVps. The secondary winding of the high voltage transformer 38 is coupled to the input of a rectifier 39 which produces the d.c. excitation voltage that is applied across the anode and cathode of the X-ray tube 12. The secondary winding of the high voltage transformer 38 is also coupled to an anode to cathode current sensor 40. The anode to cathode current sensor 40 includes a voltage-to-frequency converter which produces a feedback signal having a frequency that varies in proportion to the sensed current. This feedback signal is supplied to an input of the microcomputer 20.

FIG. 2 also illustrates the circuit details of the filament current supply 18. This circuit includes a variable d.c. power supply 42 which in response to a control signal on line 43 varies the current level at an output 44. The output 44 of the variable power supply 42 is coupled to the center tap of the primary winding for a filament transformer 45. The end terminals of the primary winding for the filament transformer 45 are coupled to system ground by switching transistors 46 and 47 and resistor 48. The secondary winding of the filament transformer 45 is coupled to the filament 15 of the X-ray tube 12. The gate electrodes of each of the switching transistors 46 and 47 are coupled to the microcomputer 20 and receive opposite phase two KHz control signals, designated filament $\phi 1$ and filament $\phi 2$. The node at which each of the transistors 46 and 47 is coupled to resistor 48 is connected to input of a current sensor 50 which produces a filament current feedback signal representative of the filament current drawn by the X-ray tube. The filament current feedback signal is connected to the microcomputer 20.

The primary winding of the high voltage transformer 38 in the high voltage supply 17 is also coupled to a stepdown transformer 51 in the filament current supply. The low voltage output from the stepdown transformer 51 is converted by a rectifier 52 to a low d.c. voltage proportional to the output voltage from the auto-transformer and hence the X-ray tube excitation voltage, KVp.

The control signal on input line 43 for the variable power supply 42 is produced by a control circuit 53. The control circuit 53 includes a first comparator 54 which receives the d.c. output voltage from the rectifier 52 and a reference level, designated "KVp reference", from the microcomputer 20. A second comparator 55 in the control circuit 53 receives the filament current feedback signal from current sensor 50 and a reference level, designated "filament current reference", from the microcomputer 20. The filament current reference level defines the nominal filament current for the X-ray exposure, while the KVp reference level defines the nominal anode-to-cathode excitation voltage. In response to these four input signals, the control circuit 53 produces a voltage control signal on line 43 to regulate the filament current. The outputs of the two comparators 54 and 55 are selected during various intervals of the exposure by selector 56 to produce the voltage control signal on line 43. The operation of the control circuit 53 will be explained further in the course of describing the operation of the X-ray generator 10.

With reference to FIG. 2, after the generator has been assembled but prior to its shipment and actual use for X-ray imaging, the various sensing circuits must be calibrated using conventional techniques.

Then, the excitation voltage KVp is measured at emission current levels of 90 and 110 milliamperes for each of the different tap combinations of the auto-transformer 23. To do so, the microcomputer 20 places the six relays K1–K6 in each of the conductive state combinations and excites the X-ray tube 12. For each relay state combination, the filament current is then varied until the emission current is 90 milliamperes; at which point the excitation voltage is measured and recorded in the microcomputer memory. The filament current is again varied until the emission current is 110 milliamperes; at which point the excitation voltage is again measured and recorded. From each of the two measurements for a given combination of auto-transformer relay states, the slope of the load line for the X-ray tube is defined and the data extrapolated to determine the excitation voltage at zero emission current. The slope of the load lines for each auto-transformer tap combination can be interpreted as the effective system resistance and the excitation voltage at zero emission current divided by the battery voltage can be interpreted as the system's effective transformer turns ratio.

The filament currents for the technician selectable exposure anode-to-cathode excitation voltages are calibrated next. In order to understand the calibration process, an explanation of the relationship between the filament current and the intensity of the X-ray emission is necessary.

FIG. 3A graphically illustrates the excitation voltage KVp and the filament current as functions of time during a typical X-ray exposure. When the X-ray exposure commences at time $T_0$, the excitation voltage KVp rises rapidly, exceeding the peak value (KVps) selected by the technician for the exposure. With time, the excitation voltage KVp decreases eventually settling at approximately the selected peak value KVps. The difference between the highest KVp value and that selected by the technician is referred to as the KVp error. The present invention is directed toward minimizing the KVp error to within an acceptable tolerance range. It should be noted that the filament current waveform depicted in FIG. 3 increases in magnitude due to the overshoot of the KVp voltage. The deviation of the filament current from the filament current reference corresponds to the KVp error.

FIG. 3B shows a set of waveforms similar to those of FIG. 3A except that for this exposure the initial rise of the anode to cathode voltage does not reach the selected level KVps. This undershoot in the excitation voltage is reflected in the filament current as a dip between times $T_1$ and $T_2$.

The filament current for the X-ray tube is calibrated for four of the predefined excitation voltage potentials selectable by the technician operating the X-ray generator 10. For example, these four preselected KVp levels may be in the range from 52 to 120 kilovolts. For each of these four excitation voltages, the two sets of auto-transformer relay state combinations are selected which will produce emission currents closest to 90 milliamperes and 110 milliamperes, the nominally acceptable emission current limits. The filament current is then calibrated at each of the these eight operation points by taking an X-ray exposure using the filament current predicted from the data collected during the previous auto-transformer tap calibrations. During each exposure, the microcomputer 20 periodically senses the filament current by sampling the filament current feedback signal from the current sensor 50. The sample values are stored temporarily in the microcomputer 20. After each exposure, the filament current error, or the deviation of the measured filament current from the filament current reference value, is integrated over the interval from $T_1$ to $T_2$ during the exposure to produce a value which is indicative of the KVp error (see FIG. 3). The result of integrating the filament current error is then employed to adjust the filament current reference value for a subsequent exposure. This integration result reflects the KVp error and by correspondingly adjusting the filament current reference value, the KVp error is reduced.

If the integrated filament current error is greater than a maximum allowable error value, another exposure is taken with the same auto-transformer tap settings and the new filament current reference value to further tune the system. This process is repeated for a number of iterations until the integrated filament current error is within an acceptable tolerance. Once this occurs, the derived filament current reference value is stored in the memory of the microcomputer 20 as value to be used for that selected combination of anode-to-cathode excitation voltage and emission current exposure parameters.

This calibration process is then repeated for each of the other chosen sets of X-ray tube calibration parameters. When the filament current reference values for all of the four chosen excitation voltages have been determined, the results are linearly interpolated to derive similar filament current reference values for each of the other operator selectable excitation voltages.

At the completion of the filament current reference calibration stage, the microcomputer 20 has stored in its memory predefined filament current reference values for each of the excitation voltage settings selectable on the control panel 21 by the X-ray technician. The generator 10 is now ready to be placed in operation for X-ray imaging.

With reference to FIGS. 2 and 3A, an X-ray diagnostic exposure is accomplished by the technician selecting one of the preset excitation potentials from the control panel 21. This information is used by the microcomputer 20 to generate the multibit KVp select signal which determines the tap combination on the auto-transformer 23 by energizing selected relays K1–K6.

At the same time, the microcomputer 20 is issuing a filament current reference signal having a level which defines the nominal filament current for the selected anode-to-cathode excitation voltage KVps. The filament current reference signal is applied to the control circuit 53 of the filament supply 18. In the control circuit, the filament current reference is compared by comparator 54 to the actual filament current level from sensor 50. The selector 56 couples the results of the comparison to the control input 43 of the variable power supply 42. The control circuit 53 is also receiving a KVp reference signal from the microcomputer 20, but this signal is not used by the control circuit until after time $T_1$, as will be described. The filament current comparison sets the output of the variable d.c. power supply 42 to a level which will produce the desired filament current in the secondary of the filament transformer 45.

To produce this current in the filament transformer's secondary, the microcomputer is concurrently outputting two filament supply switching signals, filament $\phi 1$ and filament $\phi 2$, to the transistors 46 and 47. These switching signals cause the d.c. current from the variable power supply 42 to be alternately applied through different halves of the filament transformer primary winding, thereby producing the desired alternating filament current in the secondary winding of that transformer 45.

The microcomputer then issues an exposure signal on line 26 to the start/stop control circuit 24 which applies the negative potential from battery 22 to node 25. The microcomputer is also simultaneously producing the anode $\phi 1$ and anode $\phi 2$ signals, which alternately switch SCR's 27 or 29 to generate the high excitation voltage for the X-ray tube 12. As seen in FIG. 3A, when the X-ray exposure commences at time $T_0$, the peak excitation potential KVp rises rapidly and the filament current may change slightly from its nominal pre-load level. As described previously, the excitation voltage in this exemplary exposure exceeds the selected excitation voltage KVps then decays to that selected level.

For a predefined interval $T_0$–$T_1$, which for example is several milliseconds (e.g. seven to ten milliseconds) in duration, the filament current is maintained constant at the level prescribed by the filament current reference signal. This is achieved by the control circuit 53 regulating the filament current during this interval in response solely to the comparison of the actual filament current, as represented by the feedback signal from current sensor 50, to the filament current reference value from the microcomputer 20. During this initial interval of the exposure, the excitation voltage KVp is changing rapidly which makes it impractical to use its level in a feedback control loop.

By time $T_1$, the excitation voltage KVp has risen to approximately the selected value KVps and can be utilized for the exposure regulation. At this time, the selector 56 couples the output of the second comparator 55 to the control input 43 of the variable power supply. This results in the filament current being regulated by the comparison of the KVp reference value to the feedback signal from the rectifier 52 which corresponds to the actual anode-to-cathode excitation voltage KVp. At time $T_1$, since the excitation voltage can be above or below the desired level, the filament current is adjusted to vary the cathode temperature and thereby reduce the excitation voltage error, i.e the KVp error. Up until this time, the filament control circuit 53 ignored the voltage feedback signal from rectifier 52 and the KVp reference signal. The delay in activating the excitation voltage feedback control of the filament supply is necessary to allow the microcomputer 20 to read the "loaded" filament current as indicated by the feedback signal from the filament current sensor 50, as well as to prevent the excitation voltage feedback loop from attempting to correct for the initial rise of the excitation voltage KVp.

Commencing at time T1, the microcomputer 20 periodically samples the filament current feedback signal from current sensor 50 The deviation of the filament current samples from the filament current reference value is integrated over the interval from time $T_1$ until time $T_2$, which is selected to be longer than the period of significant KVp error. The integrated filament current provides an indication of the KVp error during the sampling period. After the exposure is completed, the integrated filament current is employed to redefine the filament current reference value for the selected anode-to-cathode excitation voltage. The filament current reference value is adjusted to reduce the KVp error during the portion of the exposure between $T_0$ and $T_1$ when the reference value is used in the filament current control loop. For example, if the overshoot of the KVp voltage shown in FIG. 3A produces an unacceptable KVp error, the filament current reference value is increased by an amount corresponding to the magnitude of the error. The next time that the same excitation voltage is selected for an exposure, the redefined filament current reference value will be used to determine the initial X-ray tube filament current.

This process dynamically adjusts the filament currents associated with the predefined anode-to-cathode excitation voltages to compensate for the aging of the X-ray tube, and variations in the operating characteristics of the circuit.

We claim:

1. In an X-ray imaging apparatus having an X-ray tube, a source of an excitation voltage for the tube, and a source of filament current for the tube, the improvement being a filament current regulating circuit comprising:

a first means for comparing the filament current to a predefined reference current value;

a second means for comparing the excitation voltage to a predefined reference voltage value; and means for regulating the filament current applied to the tube, said means for regulating being responsive to only the first means for comparing during a first period of time from the start of an X-ray exposure, and after the first period of time being responsive to the second means for comparing.

2. The X-ray diagnostic apparatus as recited in claim 1 wherein said means for regulating is substantially responsive to only the second means for comparing after the first period of time.

3. The X-ray diagnostic apparatus as recited in claim 1 further comprising means for integrating the difference between the filament current and the predefined current reference value, wherein the integrating occurs over a second period of time during an X-ray exposure.

4. The X-ray diagnostic apparatus as recited in claim 3 wherein the second period of time commences after the first period of time.

5. The X-ray diagnostic apparatus as recited in claim 3 further comprising means, responsive to said means for integrating, for re-defining the filament current reference value.

6. The X-ray diagnostic apparatus as recited in claim 3 further comprising means, responsive to said means for integrating, for re-defining the filament current reference value for a subsequent X-ray exposure.

7. The X-ray diagnostic apparatus as recited in claim 1 further comprising:

means for integrating, over a second period of time during an X-ray exposure, the difference between the value of a electrical parameter of the X-ray tube and a predefined reference value for the electrical parameter; and means, responsive to said means for integrating, for redefining the reference value for the electrical parameter.

8. An X-ray diagnostic apparatus having an X-ray tube with an anode, a cathode and a filament, and including a source of an anode-to-cathode voltage and a source of filament current, said apparatus comprising:

means for selecting a given anode-to-cathode voltage for an X-ray exposure;

means for setting a filament current reference value for the X-ray exposure to a predefined value for the selected anode-to-cathode potential;

a regulating circuit for the filament current including a first means for comparing the filament current to the filament current reference value, and a means for altering the filament current in response to the means for comparing;

means for integrating the difference between the filament current reference value and the filament current for a given period of time during the X-ray exposure; and means for redefining the predefined value for the filament current in response to the means for integrating.

9. The X-ray diagnostic apparatus as recited in claim 8 wherein said regulating circuit further includes:

a second means for comparing the actual anode-to-cathode voltage to the voltage chosen by said means for selecting an anode-to-cathode voltage; and the means for altering the filament current also being responsive to said second means for comparing.

10. The X-ray diagnostic apparatus as recited in claim 9 wherein the means for altering of the filament current is responsive to only the first means for comparing during a first interval during an X-ray exposure, and thereafter during the X-ray exposure being responsive to the second means for comparing.

11. A method of controlling an X-ray diagnostic apparatus having an X-ray tube, a source of a high excitation voltage for the tube, and a source of filament current for the tube, said method comprising the steps of:

comparing the filament current to a predefined reference current value;

comparing the excitation voltage to a predefined reference voltage value; and regulating the filament current, during a first period of time from the start of an X-ray exposure, in response to the result from the step of comparing the filament current to a predefined reference current value; and regulating the filament current, during a second period of time after the first period, in response to the result from the step of comparing the excitation voltage to a predefined reference voltage value.

12. The method as recited in claim 11 further comprising:

integrating the difference between the filament current and the predefined reference current value during a given interval of time; and redefining the reference current value in response to the result of the integrating step.

13. The method as recited in claim 11 further comprising:

integrating the difference between the value of an electrical parameter of the X-ray tube and a predefined reference value for the electrical parameter during an X-ray exposure; and redefining the reference value for the electrical parameter in response to the integrating step.

* * * * *